US006484422B1

(12) United States Patent
Bain et al.

(10) Patent No.: US 6,484,422 B1
(45) Date of Patent: Nov. 26, 2002

(54) SOIL-EXCAVATING APPARATUS

(75) Inventors: Belinda Bain, Laguna Niguel, CA (US); Ronald Bain, Laguna Niguel, CA (US); Michael P. Shablo, Trabuco Canyon, CA (US)

(73) Assignee: Soil Surgeon, Inc., Laguna Niguel, CA (US)

( * ) Notice: Subject to any disclaimer, the term of this patent is extended or adjusted under 35 U.S.C. 154(b) by 0 days.

(21) Appl. No.: 09/888,099

(22) Filed: Jun. 22, 2001

(51) Int. Cl.[7] ..... E02F 3/88
(52) U.S. Cl. ..... 37/323
(58) Field of Search ..... 37/317, 322, 323, 37/347, 320, 321, 334; 239/129, 146, 198; 299/16, 17, 81.3; 175/67, 208, 424

(56) References Cited

U.S. PATENT DOCUMENTS

| | | | | | |
|---|---|---|---|---|---|
| 2,906,040 | A | * | 9/1959 | Hefling | 37/322 |
| 2,956,354 | A | * | 10/1960 | Varner | 37/317 |
| 5,212,891 | A | * | 5/1993 | Schuermann et al. | 37/322 |
| 5,408,766 | A | * | 4/1995 | Pobihushchy | 37/323 |
| 5,887,667 | A | * | 3/1999 | Van Zante et al. | 175/67 |
| 6,273,512 | B1 | * | 8/2001 | Rajewski | 299/17 |

OTHER PUBLICATIONS

Air Shovel By Keith Huber, Inc. —Brochure of 12 pages.–no date–.

Air Shovel Truck–Mounted "B" Series—Advertisement of 1 page.–no date–.

Air Shovel "Specifications" Dated Jun. 25, 2001 of 5 pages–no date–.

Cleaner—53–Aug. 2001 "Jake–A–Vator" Advertisement of 2 page.–no date–.

VAC–CON Jet–Digger Nozzle, John P. Applegate, Union, Ohio—Advertisement of 2 pages.–no date–.

Aquatech, Inc., *B5 and B52 Series*, 1999, 2 pages; Advertisement–no date–.

Aquatech, Inc., *Cleaning Accessories*, 15 pages, Brochure–no date–.

* cited by examiner

*Primary Examiner*—Robert E. Pezzuto
(74) *Attorney, Agent, or Firm*—Stetina Brunda Garred & Brucker

(57) ABSTRACT

A soil excavating apparatus for use in combination with a cleaning/vacuuming machine having at least one high pressure fluid supply in the vacuum line. A soil excavating apparatus is disclosed for use in combination with a cleaning/vacuuming machine having at least one high pressure fluid supply in the vacuum line. The apparatus includes a spray head secured to the vacuum line first end, and disposed substantially thereabout. The spray head is in fluid communication with the pressurized fluid supply. A plurality of inboard spray nozzles are disposed substantially thereabout. The spray head is in fluid communication with the pressurized fluid supply. A plurality of inboard spray nozzles are removably secured to the spray head and extend therefrom. The spray nozzles are angularly oriented to direct the pressurized fluid towards a center line of the vacuum line.

6 Claims, 3 Drawing Sheets

Fig. 3
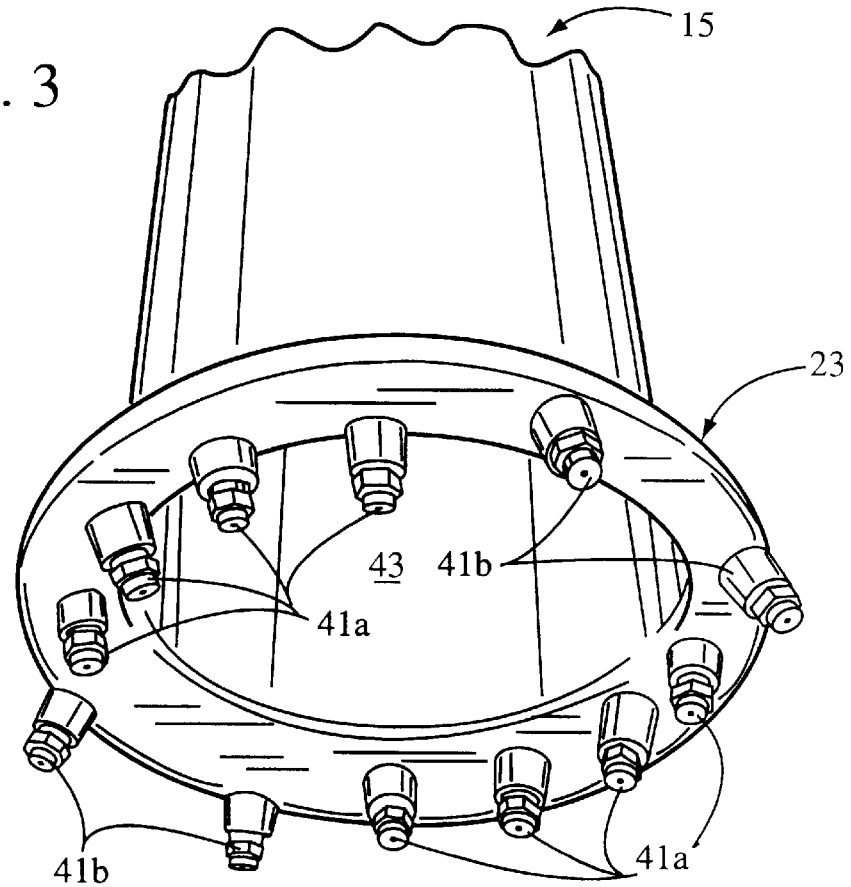
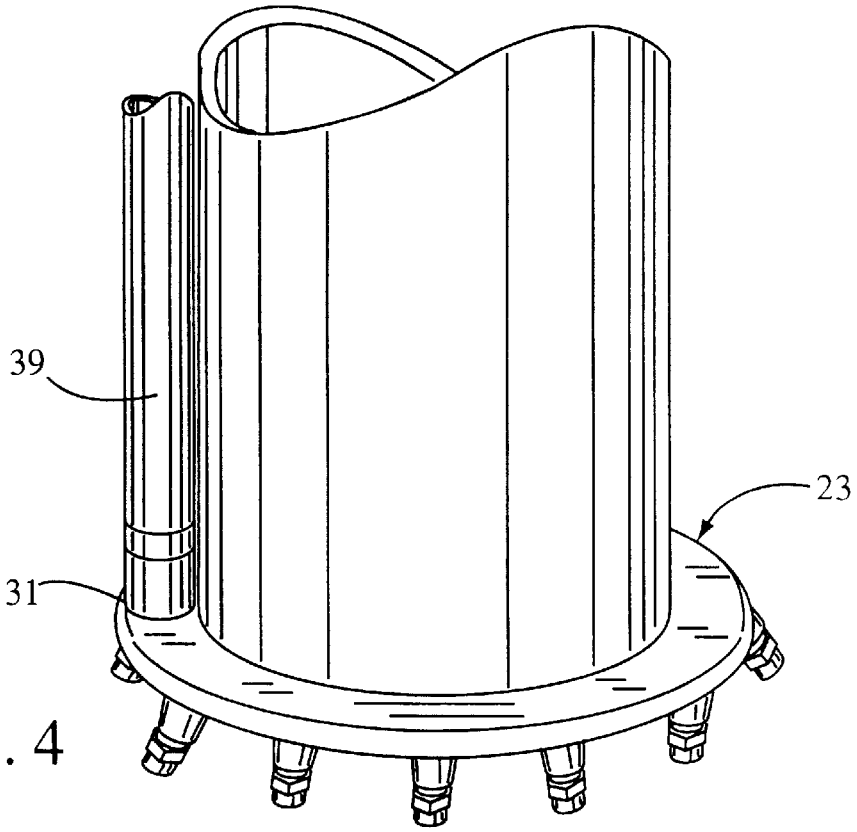
Fig. 4

SOIL-EXCAVATING APPARATUS

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention relates to soil-excavating apparatus and, more particularly, to soil-excavating apparatus adaptable for use in conjunction with portable cleaning/vacuuming machines.

Various ways exist to excavate a hole in the ground. The excavation can proceed manually, using hand tools such as shovels and picks, or mechanically, using various digging and boring devices. Manual techniques tend to be slow and labor intensive. Mechanical techniques tend to be faster, but may be unsuitable where the excavation is for the purpose of locating and exposing products that may be easily damaged, e.g., wires, gas pipe, or other utilities. Even manual techniques may result in injury to a utility, e.g., by being struck by sharp instruments such as a pick or shovel. Consequently, existing techniques for locating or excavating utilities or other sensitive objects are generally not satisfactory and suffer from drawbacks relating to speed and potential damage to objects within the excavation area.

Hydro-excavating techniques have been used for a variety of purposes in the past. However, those techniques have not proved useful to effect confined excavations. Moreover, such techniques may result in wide-spread debris and unsafe working conditions. Accordingly, there exists a need to develop a fluid-excavating apparatus and technique whereby careful excavation may be effected in a relatively small area, with little spread of debris or creation of dangerous working conditions.

It is a further object of the invention to provide an apparatus and technique whereby areas may not only be quickly excavated, but may also be quickly refilled with a minimum spread of debris.

It is a further object of the invention to provide an apparatus and technique for excavating which may utilize different excavating fluids, e.g., water or air, alone or in combination, as appropriate for different soil conditions.

It is yet another object and advantage of the present invention to obtain the above-referenced objects and advantages utilizing existing vacuuming/cleaning trucks, by adapting such vehicles for use in conjunction with the present invention.

BRIEF SUMMARY OF THE INVENTION

A soil excavating apparatus is disclosed for use in combination with a cleaning/vacuuming machine having at least one high pressure fluid supply in the vacuum line. The apparatus includes a spray head secured to the vacuum line first end, and disposed substantially thereabout. The spray head is in fluid communication with the pressurized fluid supply. A plurality of inboard spray nozzles are disposed substantially thereabout. The spray head is in fluid communication with the pressurized fluid supply. A plurality of inboard spray nozzles are removably secured to the spray head and extend therefrom. The spray nozzles are angularly oriented to direct the pressurized fluid towards a center line of the vacuum line.

The fluid supply may be a pressurized water supply, e.g., at 2,000 to 2,500 psi, or a pressurized air supply, at 100 psi. In practice, water and/or air may be utilized as the excavating fluid in accordance with the particular soil conditions and pressurized supplies.

The inboard nozzles are preferably oriented to define non-intersection fluid paths to maximizing boring efficiency of the fluid.

The spray nozzles are preferably oriented at an angle of approximately 22° in relation to the vacuum center line. The orientation of the spray nozzles, size of spray nozzle apertures, pressure and flow rates are selected to facilitate breaking up and movement of the soil proximate towards the vacuum line whereupon the soil and fluid are drawn into the vacuum line and transported to the truck.

A plurality of outboard nozzles may also be provided on the spray head, oriented at an angle away from the vacuum center line. The outboard nozzles are operative to excavate an area exterior to the spray head, to widen the area of excavation.

BRIEF DESCRIPTION OF THE DRAWINGS

These as well as other features of the present invention will become more apparent upon reference to the drawings wherein:

FIG. 3 is a bottom perspective view of the spray head and spray nozzles;

FIG. 4 is a front view of the spray head connected to the fluid supply; and

DETAILED DESCRIPTION OF THE INVENTION

Figure 1:
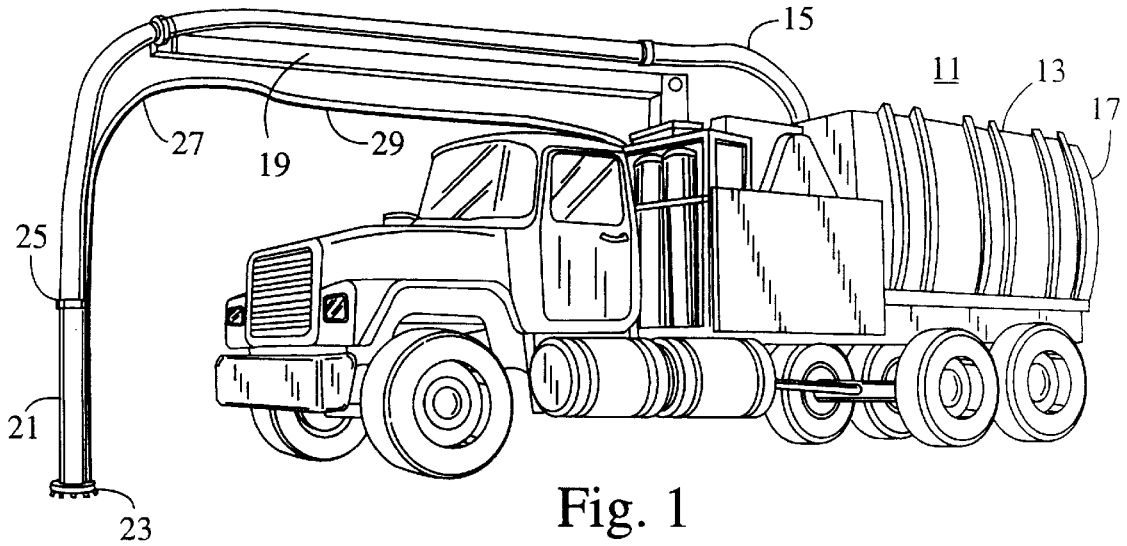
FIG. 1 is a perspective view showing use of the present invention in combination with a portable cleaning/vacuuming machine.

The detailed description set forth below in connection with the drawings is intended as a description of the presently preferred embodiment of the invention, and is not intended to represent the only forms in which the present invention may be constructed or utilized. The description sets forth the functions and the sequence of the steps for constructing and operating the invention in connection with the illustrated embodiments. It is to be understood that the same or equivalent functions may be accomplished by different embodiments that are also intended to be encompassed within the scope of the invention.

The present invention allows use of conventional cleaning/vacuuming machines, such as vacuum tank trucks, to be used to implement carefully controlled excavation about sensitive objects. Such vacuum tank trucks may be commonly used to clean storm sewers and the like. The trucks typically have large booms which have a vacuum hose and a high-pressure water hose attached. The water hoses may be used to dislodge debris from sewer lines, which is drawn into a holding tank on the truck. After the project is completed, the truck can dump the debris in an appropriate waste area.

The water system of such conventional vacuum tank trucks may pressurize water up to 2,000 to 2,500 psi. The vacuum system functions to draw debris, loosened by the high-pressure water, into the truck. The vacuum system may typically operate using a six inch or eight inch vacuum line.

The present invention utilizes modifications for conventional vacuum tank trucks, or the like, to effect a different function, i.e., boring, excavating, and refilling. The methodology by which the apparatus operates may also be varied depending upon the particular project, the type of soil, etc.

In accordance with the present invention, existing vacuum tank trucks are provided with a pressurized air line, e.g., 100–150 psi, which may be variably merged with a high-pressure water line to perform boring and/or excavating.

Pressurized air and/or pressurized water may be communicated to a spray head disposed about the vacuum line intake to bore and excavate soil. Depending upon the type of soil, the excavating fluid may be air, water, or a combination thereof.

For example, for harder soils, the excavation may proceed by communicating pressurized water to the spray head nozzles to bore the hole. Where the soil is sandy, it may be more efficient to utilize air as the excavating fluid. However, even where the soil is sandy, it may be useful to utilize water as the excavating fluid to wet the surrounding area and keep down dust that may arise during the air excavating process. In yet other applications, water and air may be simultaneously communicated to the spray head nozzle to jointly be utilized as the excavating fluid. Accordingly, the invention contemplates the alternate/simultaneous use of different fluids to facilitate excavation of soil.

The excavation utilizes the boring features of fluids to loosen and move soil to an area wherein it may be readily into the vacuum area for transport to the vacuum tank. Such loosening and movement is facilitated by arranging the inboard spray nozzles to spray towards the vacuum center line. In the presently preferred embodiment, the inboard nozzles are directed such that the fluid paths do not intersect each other. This has been found to maximize the boring capacity of the fluid sprays, and therefore the efficiency of the invention. Outboard nozzles may also be provided to loosen the surrounding area outboard of the spray head. Using the present invention, a hole ten feet deep and three feet wide can be dug in approximately one to two minutes, using a single operator. The particular speed of digging is, however, typically a function of the type of soil as well as the water/air pressure used.

By use of the present invention, utility lines, and other such objects can be exposed and accessed, by a single operator in a short time, with less danger of damaging the utility than typically results from the use of sharp digging instruments.

After digging is complete, the hole may be refilled by backing the truck up to the hole, opening the containment area and poring the debris back into the hole. As a consequence, the whole excavation/fill process can be effected in a short time, by a single operator. This provides significant economies, and adds additional functionality to conventional vacuum tank trucks which expands the market potential for such trucks.

Referring to the drawings, FIG. 1 illustrates the use of the present invention in combination with a conventional cleaning/vacuuming machine such as a vacuum tank truck. The truck 11 incorporates a vacuum tank 13 connected to a vacuum line 15. Debris entering line 15 is communicated by vacuum pressure to tank 13 for storage. After excavation is complete, the truck 11 may be backed up to the hole and truck door 17 may be lifted so that the debris may be redeposited within the hole.

The truck 11 typically includes a boom 19 operative the swing the vacuum line 15 towards the area to be excavated. At the end of vacuum line 15, a cylindrical adaptor 21 may be provided to interface the vacuum line 15 to the spray head 23. The vacuum is communicated through the adapter 21 so as to draw a vacuum input proximate the spray head 23. Coupling 25 functions to engage the adapter 21 to the supply line 15. It is anticipated that different types of couplings may be used as coupling 25 depending upon the size and configuration of the vacuum line 15.

As indicated above, pressurized water and/or pressurized air may be communicated from pressurized supplies disposed on truck 11 to the spray head 23. As shown at FIG. 1, air supply 27 and water supply 29 are communicated from truck 11 to the spray head 23. In the presently preferred embodiment, the water is pressurized at approximately 2,000 to 2,500 psi. Air is pressurized at approximately 100 psi.

Figure 2:
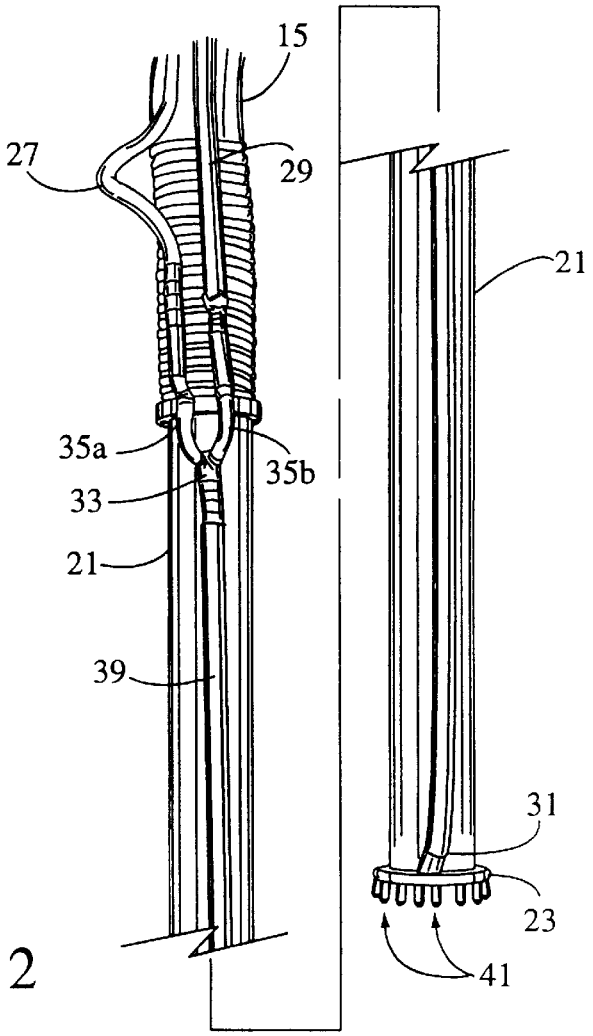
FIG. 2 is a front view of one embodiment of the invention connected to high-pressure water and/or pressure air supply lines.

As shown at FIG. 2, air supply line 27 and water supply line 29 may be communicated to a wide-shaped valving member 33, disposed intermediate the air/water supply and the spray head 23. The valving member 33 may be implemented as a Y-shaped conduit having check valves disposed in each of the portions 35*a*, 35*b* to prevent air/water from one line to return to the truck on another line.

Air and/or water communicated to the valving member 33 travels along conduit 39 to valve head 23. The valve head 23 includes a connector 31 which communicates fluid flowing there through into the interior of the lane shaped spray head 23. The fluid is communicated from the interior of the spray head 23 to the nozzles 41.

FIG. 3 provides further illustration of the spray head 23 and spray nozzles extending therefrom. The spray head 23 is attachable to the cylindrical adapter 21 by any convenient mechanism. In the presently preferred embodiment, the spray head 23 is detachable from the cylindrical adapter 21 to facilitate use of spray heads having different patterns of spray nozzles thereon. The particular choice of spray pattern may be a function of the area to be excavated, as well as the available water and air supplies.

In the presently preferred embodiment, the spray head 23 is provided with a plurality of inboard nozzles 41*a*, and outboard nozzles 41*b*. The inboard nozzles are disposed to define a fluid path angularly oriented towards the center line of the vacuum line. The inboard spray nozzles are useful to effect a boring function into the soil to loosen the soil and transport to an area proximate the vacuum line input port 43, where upon the soil may be transported into the vacuum tank. The outboard nozzles 41*b* are preferably disposed to define a spray path oriented at an angle away from the vacuum center line to loosen and excavate the area surrounding the spray head 23. The inboard nozzles 41*a* and the outboard nozzles 41*b* cooperate to loosen and move soil to an area proximate the vacuum line input port 23, where upon the soil, as well as the water or other excavating fluid is drawn into the vacuum line and communicated to the tank truck 11.

In the presently preferred embodiment, the spray nozzles are removably screwed into apertures formed in the spray head 23. The nozzles are formed to have openings of 0.88 millimeters, which has been found to be effective in soil boring functions. However, it is anticipated that other nozzles, having different sized apertures, may be used instead. In some applications, it may be useful to have different sized nozzle apertures for inboard and outboard spray nozzles.

Experimental results have indicated that boring functions are enhanced where the nozzles are oriented to define non-intersecting spray paths. Consequently, the angular orientation of nozzles 41*a* may be arrayed so that the spray paths do not converge, but pass in front of or behind each other. By such techniques, boring efficiency has found to have been the greatest.

Figure 5:
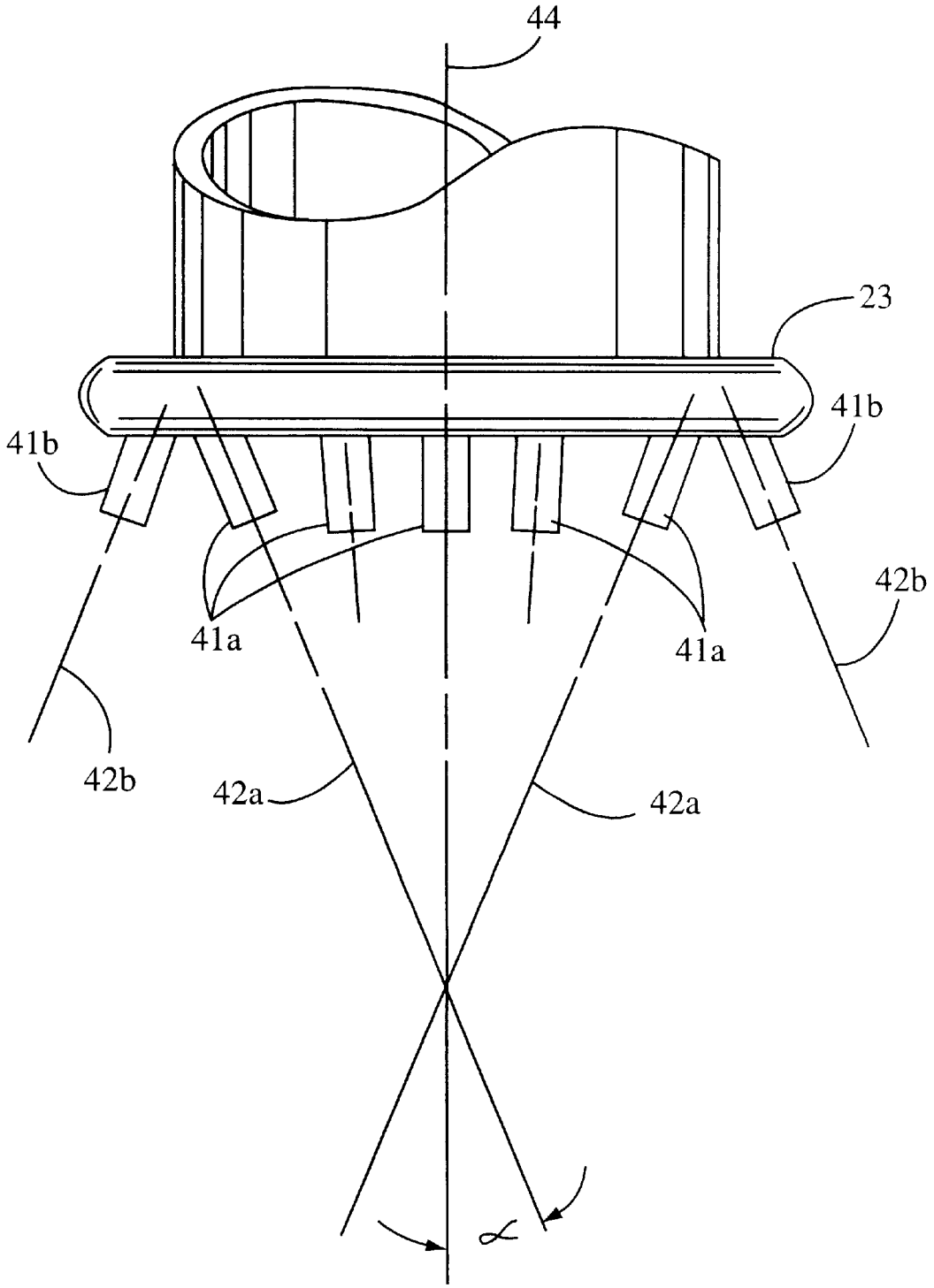
FIG. 5 is a front view of the spray head and nozzles illustrating fluid paths defined by the spray nozzle orientation.

FIG. 5 illustrates flow paths from nozzles 41*a* and 41*b*. As shown therein, spray paths 42*b* and directed outboard of the spray head 23, away rom center line 44. By contrast, spray paths 42*a* are directed towards the center line 44. However, the paths 42*a* preferably do not intersect, but rather pass in front of or behind each other to maximize boring efficiency and mitigate destructive interference between fluid paths.

As noted above, water and/or air may be communicated from the truck 11 to the nozzles 41. Depending on the type of soil, water or air may be most useful to efficiently excavate soil. Where sandy soil is present, air may be the most efficient excavating fluid, though water may be used first to wet down the surrounding area and mitigate any dust resulting from subsequent use of air to effect excavation.

Where the soil is clay or other harder material, water may be the most effective fluid to implement excavation. The choice of fluid, and the sequence in which the fluids may be used, are matters that may be determined based upon existing conditions at the excavation site.

By means of the present invention, an area may be quickly excavated while minimizing any damage to objects lying within the excavated area. It has been found that an area ten feet deep and three feet wide can be excavated in approximately one to two minutes using the present invention. However, results may vary depending upon soil conditions, pressure conditions, etc.

Inboard spray nozzles are oriented at an angle alpha in relation to the center line of the vacuum line. In the presently preferred embodiment, the optimal angle alpha has been found to be angle 22°. However, it is contemplated that a larger angle, e.g. 45°, may also be utilized.

For the spray nozzle apertures currently used, 0.8 millimeters, a flow rate of two gallons per minute is used. However, as will be recognized by those of ordinary skill, high flow rates may be used for larger apertures. Given the number of apertures in the presently preferred embodiment, i.e., 12, the total flow rate to the spray head is 24 gallons per minute. This is well within the range of flow rates typically available from conventional vacuum tank trucks, which may be up to 80 gallons per minute.

Additional modifications and improvements of the present invention may also be apparent to those of ordinary skill in the art. Thus, the particular combination of parts described and illustrated herein is intended to represent only a certain embodiment f the present invention and is not intended to serve as a limitation of alterative devices also within the spirit and scope of the invention.

What is claimed is:

1. Soil-excavating apparatus for use in combination with a cleaning/vacuuming machine having at least one high-pressure fluid supply and a vacuum line, the apparatus comprising:

a) a spray head fixedly secured to the vacuum line first end and disposed substantially thereabout, the spray head being in fluid communication with the fluid supply; and b) a plurality of inboard spray nozzles arrayed annularly about and extending from the spray head, the spray nozzles being angularly oriented to direct the pressurized fluid downwardly and inwardly towards a center line of the vacuum line; and c) a plurality of outboard spray nozzles arrayed annularly about the spray and extending from head, and oriented at an angle downwardly and outwardly away from the vacuum center line.

2. The apparatus as recited in claim 1 further comprising a fluid valving device disposed intermediate the fluid supply and the spray head, the valving device being operative to communicate at least one of a high-pressure air source and a high-pressure water source to the spray head.

3. The apparatus as recited in claim 1 wherein the inboard spray nozzles are oriented to define non-intersecting fluid paths.

4. The apparatus as recited in claim 1 wherein the spray nozzles are oriented at approximately a 22° angle in relation to the vacuum center line.

5. The apparatus as recited in claim 1 wherein the spray nozzles are oriented at approximately a 45° angle in relation to the vacuum center line.

6. The apparatus as recited in claim 1 wherein the spray nozzles are oriented to send a fluid stream toward an area of soil proximate the vacuum line first end, thereby facilitating movement of the soil and suction of the soil and fluid into the vacuum line.

* * * * *